United States Patent [19]

Sander et al.

[11] 4,388,511

[45] Jun. 14, 1983

[54] MICROWAVE HEATING APPARATUS FOR CIRCULABLE MEDIA

[75] Inventors: Wolfgang Sander, Ortenberg; Ernst-Günter Jung, Breuberg, both of Fed. Rep. of Germany

[73] Assignee: Jung GmbH, Offenbach am Main, Fed. Rep. of Germany

[21] Appl. No.: 265,358

[22] Filed: May 20, 1981

[30] Foreign Application Priority Data

May 23, 1980 [DE] Fed. Rep. of Germany ..... 3019720

[51] Int. Cl.[3] ..... H05B 9/06

[52] U.S. Cl. ..... 219/10.55 R; 219/10.55 A

[58] Field of Search ..... 219/10.55 R, 10.55 A, 219/10.55 D, 10.55 F

[56] References Cited

U.S. PATENT DOCUMENTS

| | | | |
|---|---|---|---|
| 3,594,530 | 7/1971 | Wiegmann | 219/10.55 A |
| 3,963,892 | 6/1979 | Camph et al. | 219/10.55 A |
| 3,983,356 | 9/1976 | Jurgensen | 219/10.55 A |
| 4,114,011 | 9/1978 | Stubbs | 219/10.55 R |
| 4,152,567 | 5/1979 | Mayfield | 219/10.55 A |

FOREIGN PATENT DOCUMENTS

| | | | |
|---|---|---|---|
| 4256964 | 5/1964 | Australia | 219/10.55 A |
| 1565731 | 9/1971 | Fed. Rep. of Germany . | |
| 2019012 | 11/1971 | Fed. Rep. of Germany . | |
| 972524 | 1/1951 | France | 219/10.55 A |
| 544477 | 12/1973 | Switzerland . | |
| 1185363 | 3/1970 | United Kingdom . | |
| 1222208 | 2/1971 | United Kingdom . | |
| 1255690 | 12/1971 | United Kingdom . | |

*Primary Examiner*—B. A. Reynolds
*Assistant Examiner*—Catherine M. Sigda
*Attorney, Agent, or Firm*—Toren, McGeady and Stanger

[57] ABSTRACT

In a microwave apparatus for media which can be circulated and heated by high frequencies, an elongated shaft having a rectangular cross-section transverse to the elongated direction is provided at one end with a microwave transmitter. At the one end the shaft forms a hollow wave guide followed to the opposite end by a resonator chamber. The shaft has the same cross-sectional shape between its ends. A microwave permeable conductor in the form of a hairpin-shaped loop extends through the resonator chamber from the opposite end. The opposite end of the shaft is closed off by a flange plate secured to a flange on the shaft and the inlet and outlet ends of the loop are located in the flange plate.

5 Claims, 4 Drawing Figures

MICROWAVE HEATING APPARATUS FOR CIRCULABLE MEDIA

The invention relates to a microwave apparatus for heating circulable media which can be heated by high frequencies, and consisting of a microwave transmitter, a hollow waveguide and a resonator chamber with a line disposed therein to carry the heatable medium and permeable to microwaves.

In the case of microwave heating apparatuses which are already within the current state of the art, as is usual in the case of other microwave ovens, the hollow waveguide is constructed as a cylindrical tube which discharges into a parallelepiped resonator chamber. In consequence, there is a partial coupling-out of the resonator so that the efficiency of such apparatuses is limited to about 60%. The other 40% of the electrical energy supplied is given off to the ambient air by the necessary cooling of the microwave transmitter (magnetron) and via the waste heat from the transformer. It is true that these losses can be recovered in the immediate vicinity of the heating apparatus and employed for heating purposes because a kind of hot air heating is created, but on design grounds, transport of the hot air to nearby rooms is prevented. Where any such measure is concerned, in fact, the known disadvantages of warm air heating have to be taken into account. Where the same solution, already part of the state of the art, is concerned, it has already been suggested that to improve the utilisation of energy, the microwave-permeable line disposed in the resonator chamber should be given some particular configuration wherein the curved central axis of the tube forming the line is roughly on the surface of a right-angled truncated pyramid. The construction of hollow waveguide and resonator, but particularly the construction of the microwave-permeable line call for complicated structural and manufacturing measures to be adopted which complicate and make the relevant microwave heating apparatus more expensive.

The invention is based on the problem of improving a microwave heating apparatus so that it is more simply designed and has a higher degree of efficiency in terms of conversion of microwave energy to heat which can be dissipated from the heatable medium.

In the case of the microwave heating apparatus described at the outset, the problem posed is according to the invention resolved in that hollow waveguide and resonator chamber have substantially the same cross-section, are aligned with each other and are serially disposed in a longitudinal direction and in that the microwave-pervious line extends through the resonator chamber substantially in a longitudinal direction.

By reason of the measures indicated, hollow waveguide and resonator chamber can be constituted by a single continuous parallelepiped space which in a particularly advantageous manner is defined by a common parallelepiped shaft. This shaft can easily be constructed from angled-over sheet metal parts. By virtue of leading the microwave-pervious line in a longitudinal direction through this relatively narrow shaft, the line and the heatable medium present therein become very intensively exposed to the microwave field so that it was possible to note an increase in efficiency to 78%. In this case, only 22% of lost heat has to be dissipated by the above-described cooling into the ambient air, i.e. the proportion of "air heating" is reduced to about half.

However, a particular advantage arises in respect of the simple manufacturing and fixing possibility of the line which is disposed substantially rectilinearly in the resonator chamber.

According to a further feature of the invention, a particularly advantageous development of the object of the invention resides in that hollow waveguide and resonator chamber are formed by a common parallelepiped shaft extending in the direction of the longest axis of the microwave transmitter as far as an end wall disposed at the end, and in that the microwave-permeable line is constituted by a hairpin-shaped loop, of which the open ends extend through the end wall.

The fact of bending the line once into a hairpin-shaped loop, i.e. into a structure, consisting of two long straight legs and a yoke connecting these results in a line the connection ends of which are disposed immediately one beside the other and which can be extremely easily incorporated into the shaft.

For the purpose of mounting the loop, it is according to a further feature of the invention particularly expedient to proceed in such a manner that in the region of the end wall the shaft is provided with a flange directed at a right-angle to the longitudinal axis and in that the ends of the hairpin-shaped loop are secured in a flange plate which is adapted to be connected to the flange in such a way as to be tight to microwaves. The relevant flange plate can at the same time serve for mounting connection leads which are accommodated in a further flange plate. Flange and flange plates can be clamped to one another by common screws.

It is particularly advantageous to use as materials for the microwave-pervious line polypropylene or polytetrafluoroethylene which have been found to be particularly suitable for this purpose. As the heating medium, virtually all media are possible which can be heated by high frequency. Vegetable oils taken from the group comprising sunflower oil, groundnut oil and soya bean oil have already proved to be very acceptable (German Offenlegungsschrift 29 28 520).

For high frequency heating, the German Federal Post Office has allocated the frequency of 2450 MHz. For such a frequency, and within a tolerance of ±50 MHz, it has been found particularly advantageous if the main dimensions of the apparatus correspond to the dimensions where the internal dimensions of the shaft are as follows: length: 560 mm, width: 86.4 mm and height: 43.2 mm; and the dimensions of the hairpin-shaped loop are as follows: outside the diameter: 32 mm, inside tube diameter 26 mm, leg length (as far as tube axis at opex of curvature: 340 mm, and distance between the outermost generatrices in the region of the legs; 75 mm. Further the center of the transmission head is spaced 32.8 mm away from the closed end of the shaft remote from the flange. It should also be added that the object of the invention also means that the otherwise conventional field distributor in the resonator chamber can be omitted.

An example of an embodiment of the object underlying the invention and its installation in a multiple arrangement will be described in greater detail hereinafter with reference to the accompanying drawings in which:

FIG. 3 is a side view of a microwave heating apparatus built into a housing and together with the associated supply means, while

Figure 1:
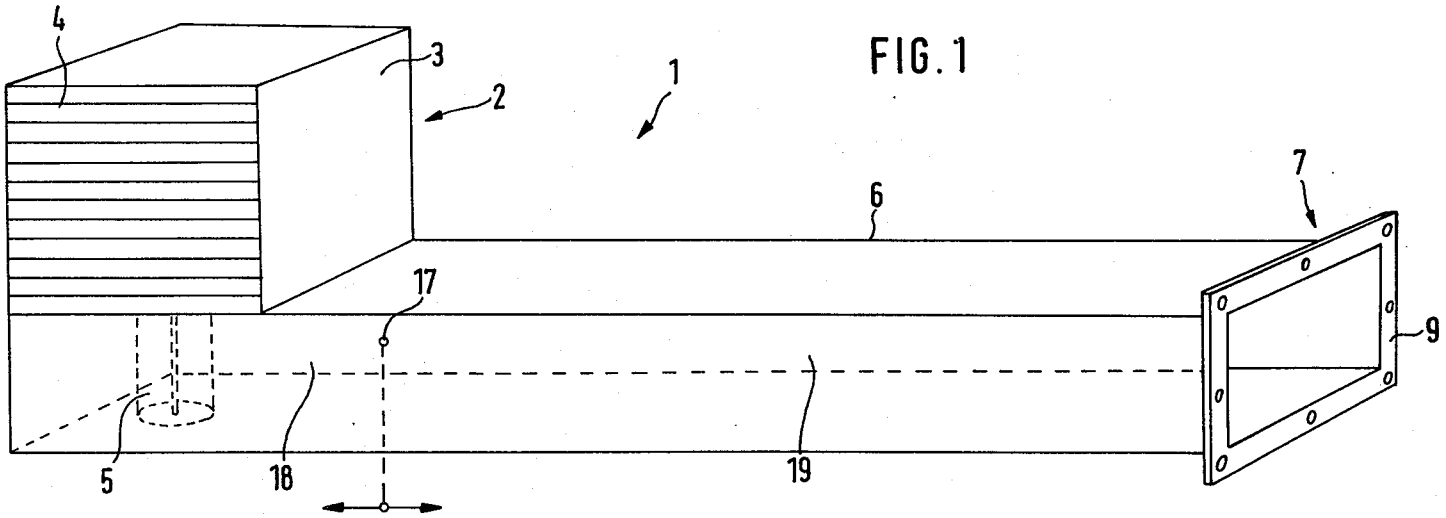
FIG. 1 is a perspective view of the essential parts of the microwave heating apparatus but with the microwave-permeable line removed.

FIG. 1 shows a microwave heating apparatus 1 which consists of a microwave transmitter 2, the most essential part of which is a per se known magnetron and of which only an outer housing 3 is visible. Located inside the housing 3 is a cooling blower and a wall 4 is provided with corresponding air vents. From the magnetron, a so-called transmitter head 5 extends at a right-angle into a parallelepiped sheet metal shaft 6, the longest axis of which extends from the microwave transmitter 2 or transmitter head 5 to a wall 7 located at the end and constituted according to FIG. 2 by a flange plate 8. In the region of the end wall 7, and aligned at a right-angle to the longitudinal axis, the shaft 6 has a flange 9 to which it is possible to screw the flange plate 8 in a microwave-tight fashion.

Fixed in fluid-tight fashion to the flange plate 8 which consists of metal is a polypropylene microwave-permeable line 10 constituted by a hairpin-shaped loop 11. The loop 11 consists of two parallel legs 12 and 13 which are joined by a yoke 14 to form a U-shaped flow duct. The direction of flow is indicated by arrows. The loop 11 has open ends 15 and 16 by which it extends in fluid-tight fashion through the end wall 7 or flange plate 8. When the flange plate 8 is bolted to a complementary matching flange plate through an interposed gasket, feed and discharge lines being disposed in the matching flange plate, as shown in FIG. 4, a closed system of flow passages is formed through which a medium adapted to be heated by high frequency can be passed via the line 10.

Figure 2:
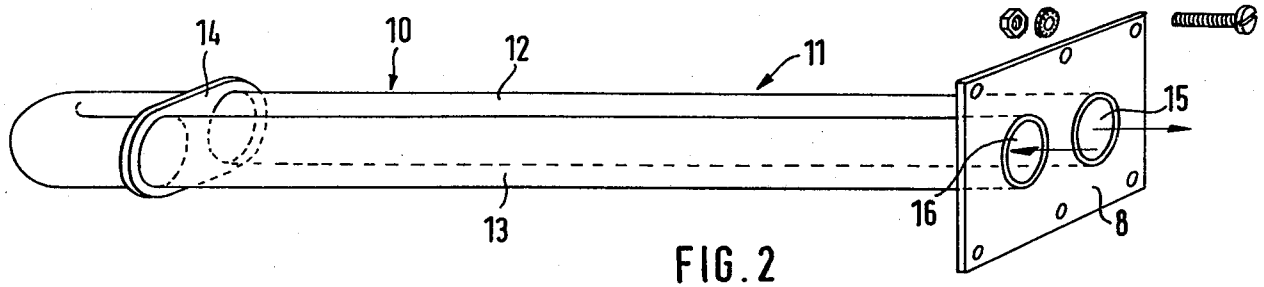
FIG. 2 shows the removed microwave-permeable line in the form of a hairpin-shaped loop, in the position of installation.

The objects according to FIGS. 1 and 2 can be combined with each other in that the loop 11 is introduced through the flange 9 into the shaft 6 until the flange plate 8 comes to a flat and matching fitment against the flange 9. When this happens, the loop 11 is completely symmetrically disposed inside the shaft 6 in a horizontal as well as in a vertical direction. The apex of curvature of the yoke 14 of the loop 11 lies thereby at a place indicated by reference numeral 17 in FIG. 1. The line 10 extends in this case over a part of the shaft length in the longitudinal direction through the shaft 6, dividing it appropriately into a hollow waveguide 18 located to the left of the location 17. The sub-division is created only by the effect of the individual portions of the shaft 6. The shaft 6 itself is continuous, has plane walls and is constructed with a constant cross-section so that in principle the loop 11 can also be regarded as being disposed in the "hollow waveguide". It is naturally also possible to sub-divide the shaft 6 in a longitudinal direction and to provide it with a square flange connection such as is illustrated in FIGS. 3 and 4.

In any case, the legs 12 and 13 of the loop 11 largely fill the internal cross-section of the shaft 6, i.e. at the locations of closest proximity of generatrices of the loop 11 and the walls of the shaft 6 there is only a gap of a few millimeters. The dimensions most favourable for a frequency of 2450±50 MHz are as follows: the internal dimensions of the shaft (6) are: length: 560; width 86.4 mm and height 43.2 mm, while the dimensions of the hairpin-shaped loop (11) are: outside tube diameter: 32 33; inside tube diameter 26 mm leg length (as far as tube axis at apex of curvature): 340; distance between the outermost generatrices in the region of the legs: 75 mm; and in that the centre of the transmission head 5 is spaced 32.8 mm away from that closed end of the shaft 6 which is remote from the flange 9. It is particularly expedient to respect these dimensions, subject to a tolerance of ±0.1 mm. If these dimensions are observed, measurements have revealed that for an electrical connection of 2.2 kW power, it was possible to achieve a high frequency power of 1.68 kW which can be transmitted to the medium which is to be heated.

Figure 3:
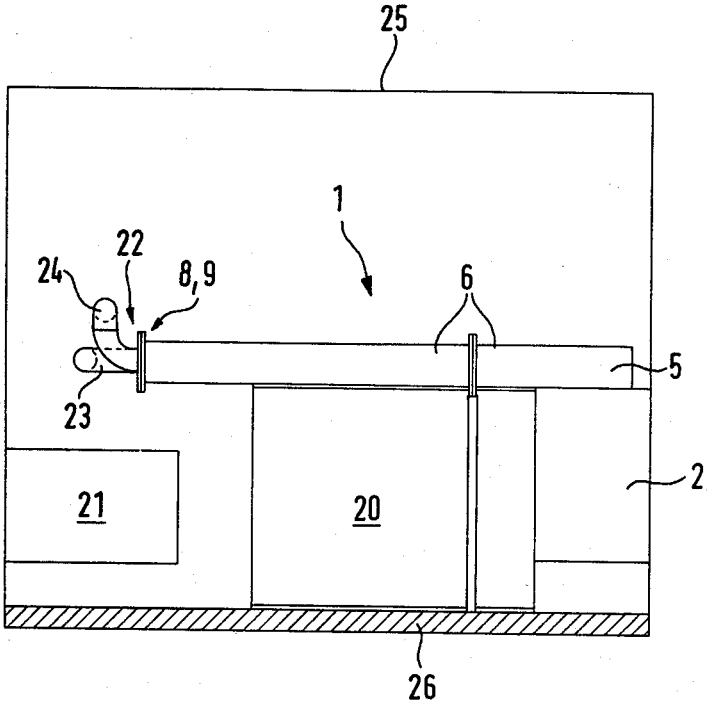
Figure 4:
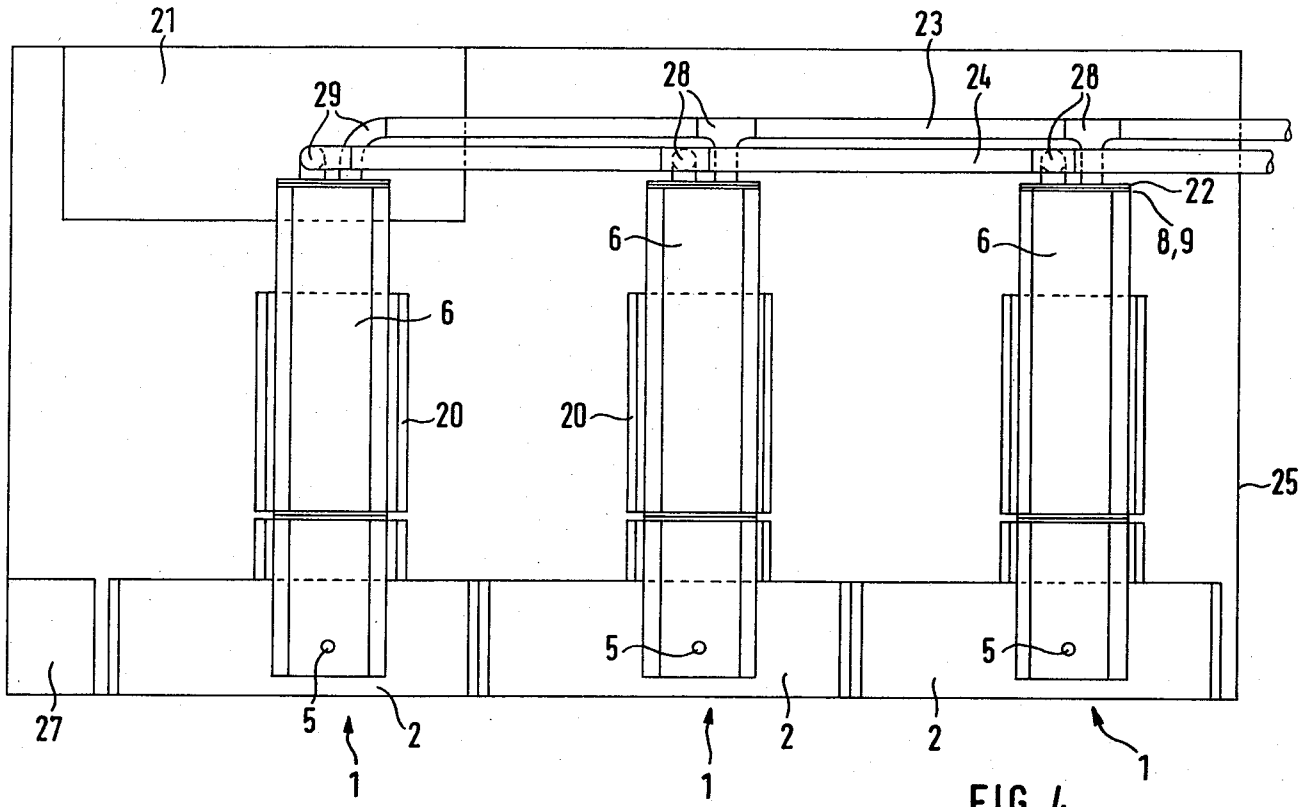
FIG. 4 is a plan view of the object according to FIG. 3, in a multiple arrangement.

The same reference numerals as hitherto are retained for FIGS. 3 and 4. There, the disposition of microwave transmitter 2 and shaft are shown reversed, i.e. the transmitter head 5 projects from below into the shaft 6 or hollow wave guide 18. The whole arrangement rests on a power supply unit 20 which takes the form of a transformer. A control cabinet is designated 21. The flange connection 8/9 is connected to a complementary matching flange plate 22 in which supply and discharge lines 23, 24 are fixed. The whole arrangement is enclosed by a housing 25 and rests on a floor 26.

FIG. 4 shows the combination of several microwave heating apparatuses 1 according to FIGS. 1 to 3 to form a bank. The individual loops 11 are thereby connected in parallel in that the supply and discharge lines 23, 24 are continuous in construction and are connected via T-pieces 28 to two of the microwave heating apparatuses 1. Connection to the last microwave heating apparatus 1 is effected via bend 29. A suppressor assembly 29 is also provided. However, parallel connection of the individual microwave heating apparatuses can be cancelled out and decentralised.

We claim:

1. A microwave apparatus for media which can be circulated and heated by high frequencies, comprising a microwave transmitter, an elongated shaft having the same rectangular cross-section transverse of the elongated direction thereof over the elongated dimension of said shaft, said shaft having a first end and a second end spaced apart in the elongated direction, said microwave transmitter opening into said shaft adjacent the first end thereof, said shaft forming a hollow wave guide extending in the elongated direction thereof from the first end toward the second end and a resonator chamber extending from the end of said wave guide closer to the second end of said shaft to the second end of said shaft, a microwave permeable conductor located within said resonator chamber and extending from the second end of said shaft for transporting the medium to be heated through the resonator chamber, and said microwave permeable conductor comprising a substantially hairpin-shaped loop having an inlet and an outlet each located at the second end of said shaft.

2. A microwave heating apparatus, as set forth in claim 1, wherein said microwave transmitter includes a transmitter head extending into said wave guide at a right angle to the elongated direction of said shaft, and said shaft has the shape of a parallelepiped extending in the elongated direction thereof.

3. A microwave heating apparatus, as set forth in claim 2, wherein said shaft at the second end thereof has a flange extending around the second end and directed at a right angle to the elongated direction of said shaft, a flange plate having the inlet and outlet of said loop secured thereto and said flange plate secured to said flange on said shaft so that it is impermeable to microwaves.

4. A microwave heating apparatus as set forth in claim 2, wherein the internal dimensions of the shaft (6) are as follows:

length: 560 mm
width: 86.4 mm
height: 43.2 mm and the dimensions of the hairpin-shaped loop (11) are as follows:

outside tube diameter: 32 mm
inside tube diameter: 26 mm
leg length (as far as tube axis at apex of curvature): 340 mm
distance between the outermost generatrices in the region of the legs: 75 mm and in that the centre of the transmitter head (5) is spaced 32.8 mm away from that closed end of the shaft (6) which is remote from the flange 9.

5. A microwave heating apparatus, as set forth in claim 4, wherein the dimensions of said shaft and said hairpin-shaped loop have a tolerance in the range of ±0.1 mm.

* * * * *